US005769340A

United States Patent [19]

Jean

[11] Patent Number: 5,769,340

[45] Date of Patent: Jun. 23, 1998

[54] POSITIONING DEVICE FOR CONCAVE OF CONE CRUSHER

[76] Inventor: Cheng-Shu Jean, No. 14, Chung Shing N. St., Sanchung Shih, Taipei Hsien, Taiwan

[21] Appl. No.: 877,177

[22] Filed: Jun. 17, 1997

[51] Int. Cl.[6] ..... B02C 2/04

[52] U.S. Cl. ..... 241/207; 241/285.1; 241/300

[58] Field of Search ..... 241/207, 208, 241/209, 210, 211, 212, 213, 214, 215, 216, 285.1, 299, 300, 286

[56] References Cited

U.S. PATENT DOCUMENTS

| | | | |
|---|---|---|---|
| 2,052,706 | 9/1936 | Guest | 241/211 |
| 2,185,528 | 1/1940 | Stevens | 241/214 |
| 2,550,098 | 4/1951 | Traylor, Jr. | 241/209 |
| 2,680,571 | 6/1954 | Bjarme | 241/290 |
| 3,063,649 | 11/1962 | Pollak | 241/299 |
| 3,190,570 | 6/1965 | Symons | 241/215 |
| 3,312,404 | 4/1967 | Allen | 241/215 |
| 3,459,383 | 8/1969 | Dediemar | 241/215 |
| 3,840,192 | 10/1974 | Hendrickson | 241/207 |
| 4,923,129 | 5/1990 | Chae | 241/207 |
| 5,163,213 | 11/1992 | Brizendine | 241/215 X |
| 5,312,053 | 5/1994 | Ganser, IV | 241/30 |

*Primary Examiner*—John M. Husar

*Attorney, Agent, or Firm*—Morton J. Rosenberg; David I. Klein; Jun Y. Lee

[57] ABSTRACT

The present invention relates to an improved positioning device for the concave of a cone crusher. The concave is provided with a plurality of tabs which are symmetrically disposed and each of the tabs is provided with a inclined surface which directs to same direction. The top cell or bottom cell is provided with a plurality of positioning device which is corresponding to each of the tabs. The positioning device is provided with a complimentary inclined and tapped surface corresponding to the inclined surface of the concave. As a result, the concave can be fixedly supported over the positioning devices. The concave can be quickly assembled while features a firm and durable engagement therebetween for life long service.

4 Claims, 14 Drawing Sheets

POSITIONING DEVICE FOR CONCAVE OF CONE CRUSHER

FIELD OF THE INVENTION

This invention relates to a positioning device, more particularly, to an improved positioning device for concave of a cone crusher in which the concave can be fixedly and conveniently attached to the top cell by the positioning device.

DESCRIPTION OF PRIOR ART

The cone crusher is used to crush a rock of larger size into small pebbles. Normally, this cone crusher is used for secondary and thirdly crushing process. As shown in FIG. 1, the conventional cone crusher generally comprises main shaft 93 which is rotated in eccentric manner such that the mantle 94 is rotated eccentrically as well. A concave 1 is attached to the top cell 3 by a U-shape locking bolt 2. Since the mantle 94 is fixedly attached to the main shaft 93 and is rotated eccentrically. By this arrangement, when the rocks arc charged from the distributer 31, the rocks are crushed between the mantle 94 and the concave 1 as the main shaft 93 and the mantle 94 are rotated eccentrically.

Theoretically, the concave 1 is exerted with a force which is perpendicular to the inner wall of the concave 1. However, this only exists when no rocks are charged, i.e. no crushing process happened between the mantle 94 and the concave 1.

When a crushing process is proceeded between the mantle 94 and the concave 1, the rock to be crushed become a substantial medium for force transferring. As a results the inertia generated by the mantle 94 and the main shalt 93 are transferred to the concave 1 by the rocks under the crushing process. Accordingly, even the concave 1 is fixedly attached to the top cell 3 by means of a U-shape locking bolt 2, a side force resulted front inertia will be applied to the concave 1 during the crushing process.

Normally, the concave 1 and the mantle 94 are a consumable material which shall be replaced after a certain of working hours. In order to facilitate a quick replacement of those worn-out elements, the concave 1 can not be fixedly attached to the top cell 3 such as through welding and the concave 1 shall be removably attached to the top cell 3, for example, by locking bolt 2. As a result, the engagement between the concave 1 and the top cell 3 is mainly decided by the convenience and stability therebetween.

In the conventional concave 1, the positioning device is a plurality of mounting lugs 11 which are integrally formed with the concave 1 during the molding process. Normally, the number of the mounting lugs 11 is 8, 6 or 4. Then a U-shape locking bolt 2 is used to hooked the bottom of the mounting lug 11. Afterward, a locking nut 21 is applied to fasten the mounting lug 11 to the top cell 3. Even this locking measurement has been applied for more than ten years and it can be concluded with the following disadvantages.

1. Normally, the bottom surface of the mounting lug 11 shall be formed with a circular portion 111 for readily hooking by the locking bolt 2. However, during the molding process, it is hard to get a smooth surface, to the contrary, blurs and rugged surface will be formed. Furthermore, this bottom surface is difficult to machine to get a smooth surface. If it must be done, many an effort shall be taken.

2. Since the circular surface 111 of the mounting lug 11 can not be machined to a smooth level, as a result, the contact between the hooking portion 22 of the locking bolt 2 is not a surface to surface contact, and is merely a point to point contact. This the point to point will occur a stress concentration and it can be readily worn out. As a result, a play between the hooking portion 22 of the locking bolt 2 and the circular portion 111 of the mounting lug 11. If the locking bolt 2 and nut 21 are not immediately tightened, the concave will be moved by the side force during the crushing process between the mantle 94 and the concave 1. Bit by bit, the locking bolt 2 will become skewed and finally broken. On the other hand, since the mounting lug 11 is biased always, it can be readily worn out or even broken.

SUMMARY OF THE INVENTION

It is the objective of this invention to provide an improved positioning device for the concave of the crusher wherein the positioning device can be readily and conveniently machined and assembled. By the provision of the positioning device, the concave can be readily and fixedly attached to the top cell or the bottom cell. The concave can be effectively prevented from moving traverse.

It is still the objective of this invention to provide an improved positioning device for the concave of the cone crusher in which the positioning device provides a self-locking function such that the engagement between the concave and the top cell become tighter and tighter.

It is still the objective of this invention to provide an improved mechanism for the concave of the cone crusher wherein the concave and its accessories are prevented from skewing or breaking.

BRIEF DESCRIPTION OF DRAWINGS

In order that the present invention may more readily be understood the following description is given merely by way of example with reference to the accompanying drawings, in which.

DETAILED DESCRIPTION OF PREFERRED EMBODIMENTS

Figure 1:
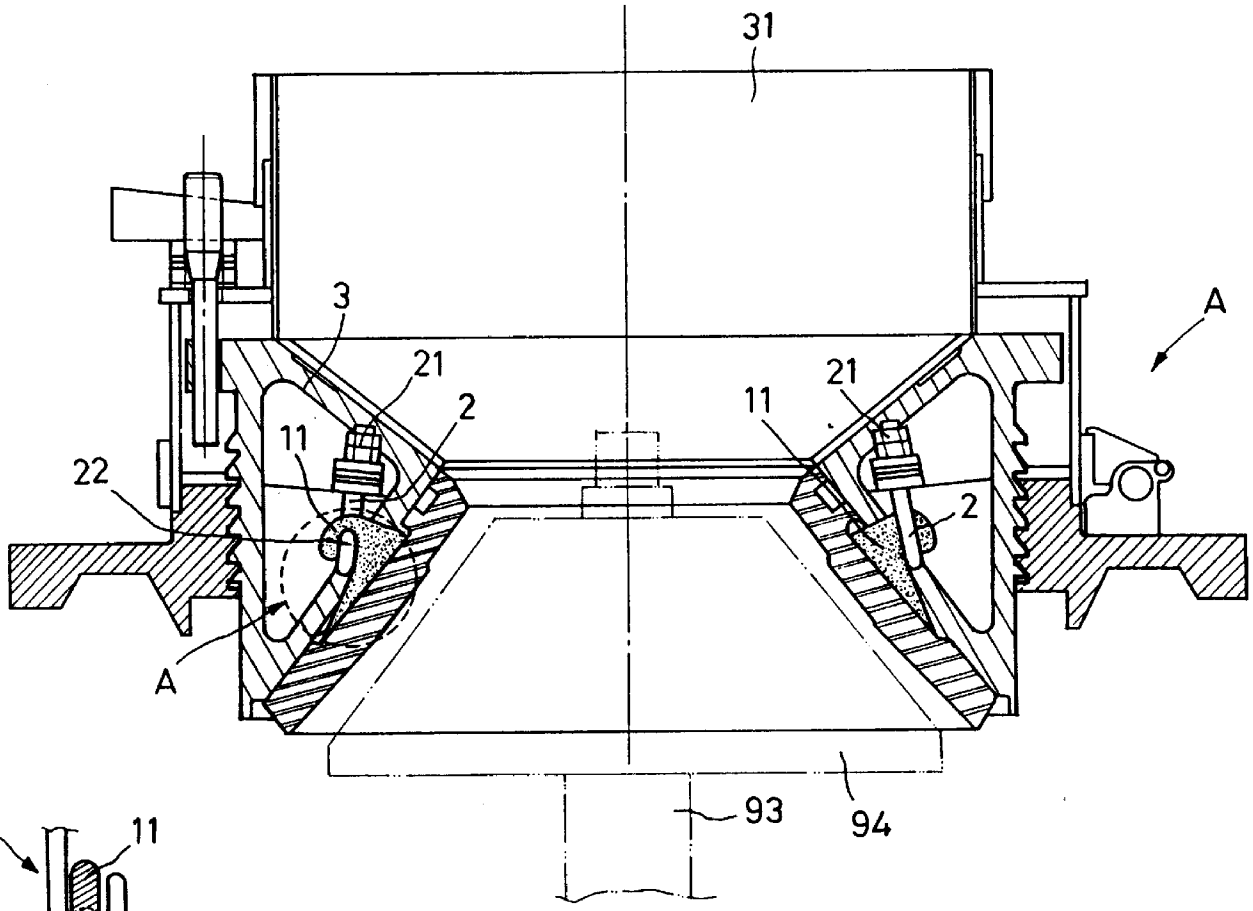
FIG. 1 PRIOR ART
FIG. 1 is a schematic illustration of a conventional cone crusher in which the positioning device is shown.
Figure 1A:
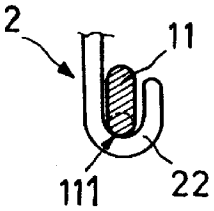
FIG. 1(A) PRIOR ART
FIG. 1A is an enlarged view of the looking portion and the lug circled by A in FIG. 1.

Referring to FIGS. 2 to 6. the cone crusher generally comprises:

A top cell 4 which has a cylindrical bell shape which has a larger top portion and a small lower portion and an inclined inner wall 41 is defined between the top portion and the lower portion.

A concave 5 has a cylindrical bell shape which has a larger top portion and a small lower portion. The inner wall 51 of the concave is a working surface for crushing the rocks and the outer wall is shaped to meet complimentary to the inclined surface 41 of the top cell 4.

And a positioning device 6 which is used to attach fixedly the concave 5 to the inclined inner wall 41 of the top cell 4.

Characterized in that the inclined inner wall 41 of the top cell 4 is provided with a plurality of slots 42 which are symmetrically to each other. A shallow groove 43 is formed below the slot 42 and a through hole 421 which passes through the top cell 4 is disposed above the slot 42.

The concave 5 is provided with an inclined rib 54 which is corresponding to the slot 42 of the top cell 4 at the lower peripheral 53. The inclined angle of the bottom inclining surface 541 of the rib 54 is identical to each other.

The positioning device 6 is formed with a projected tab 61 which faces to the slot 42 of the top cell 4. The tab 61 is provided with a threaded opening 611 in which a locking bolt 7 can be locked thereof through the through hole 421. Furthermore, the bottom surface of the positioning device 6 which faces the inner surface of the concave 5 is formed with an extension 62 which has a tapped surface 621 corresponding, to the bottom inclining surface 541 of the rib 54.

By this arrangement, the positioning device 6 can be readily inserted into the slot 42 and the groove 43 and it call be adjusted by a locking bolt 7 for its height. As a result, the tapped surface 621 of the extension 62 provides a substantial support to the rib 54 of the concave 5.

Figure 2:
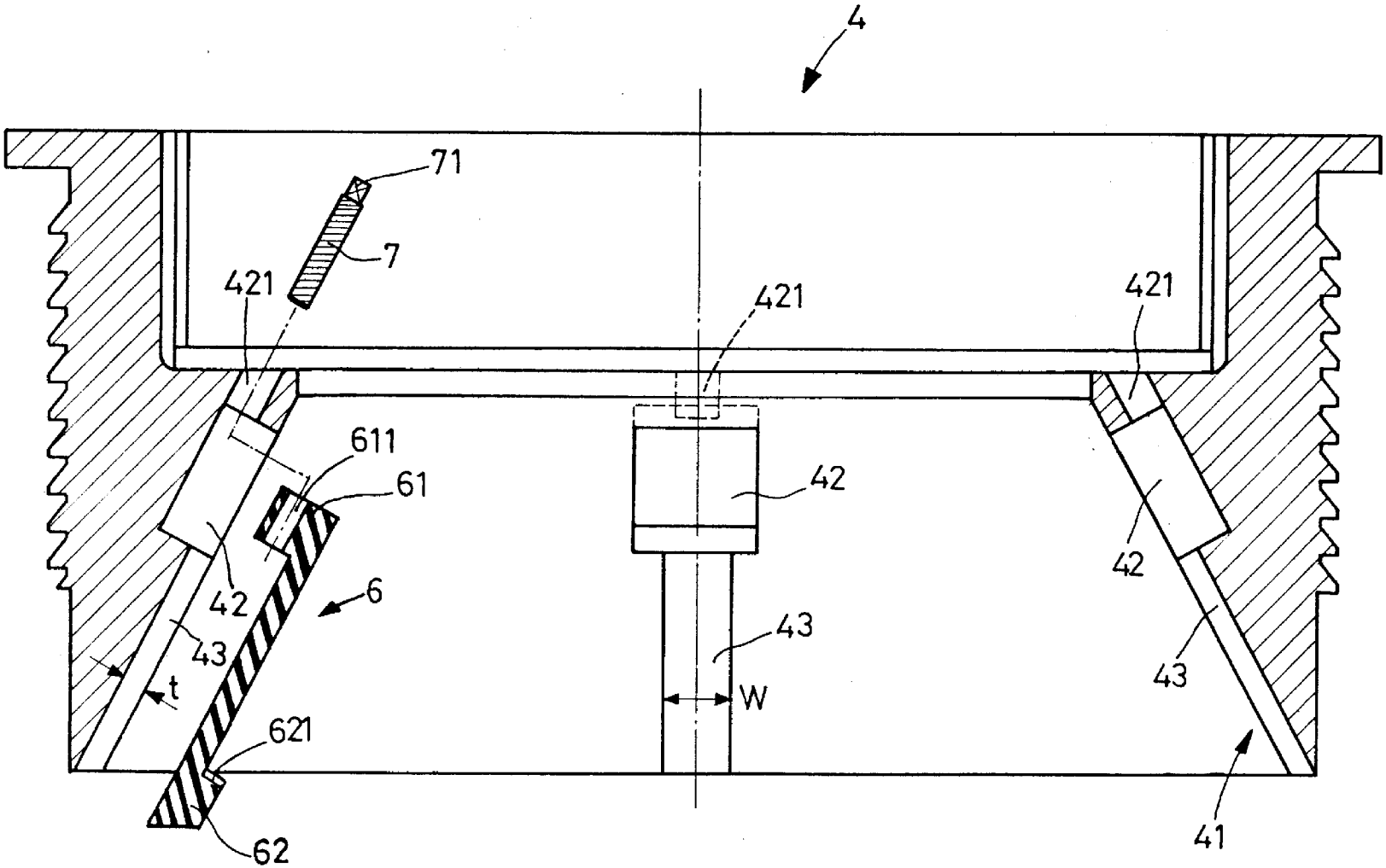
FIG. 2 is a cross sectional view of the cone crusher in which the top cell and the positioning device are clearly shown.
Figure 3:
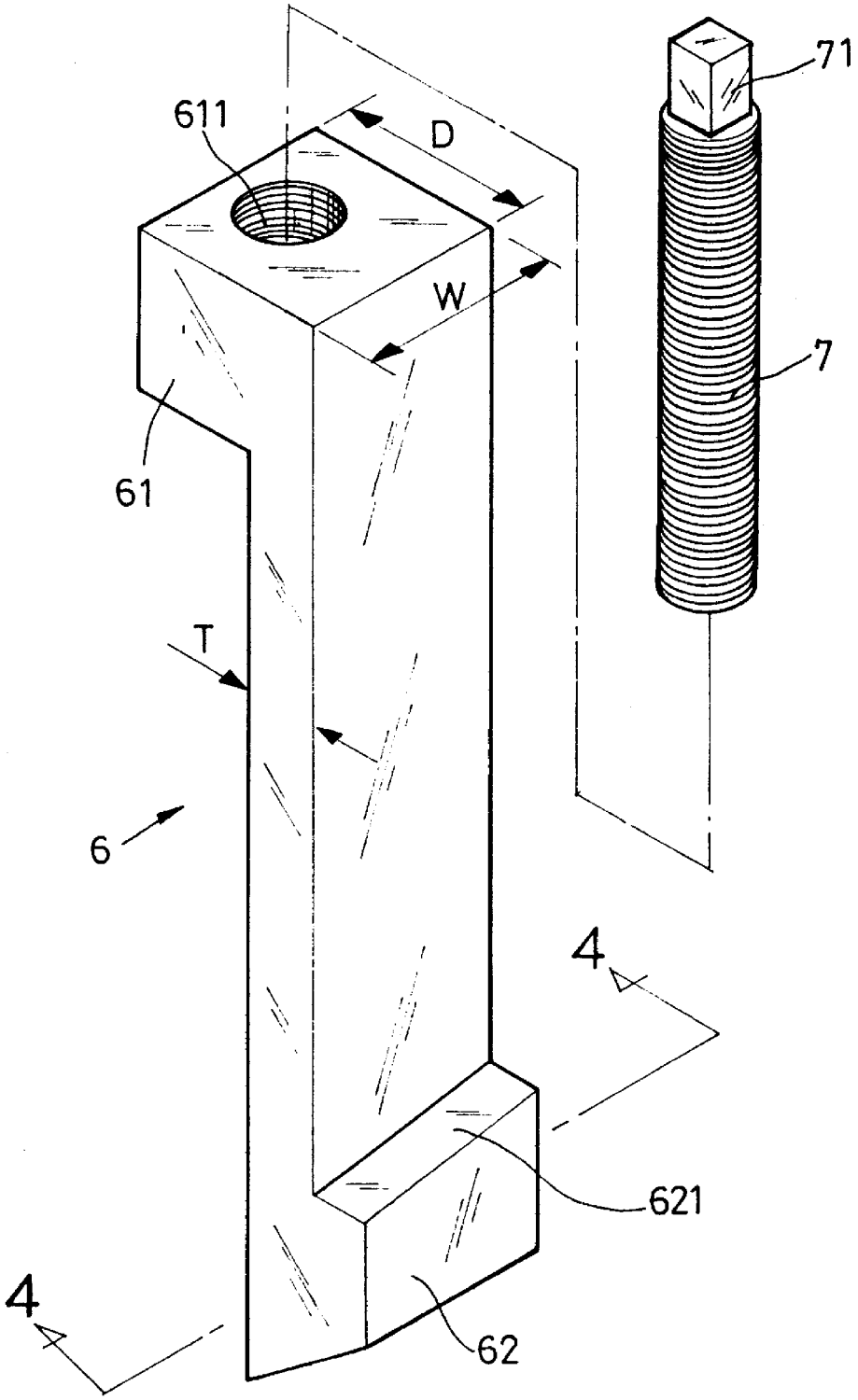
FIG. 3 is a perspective view of the positioning device shown in FIG. 2.
Figure 4:
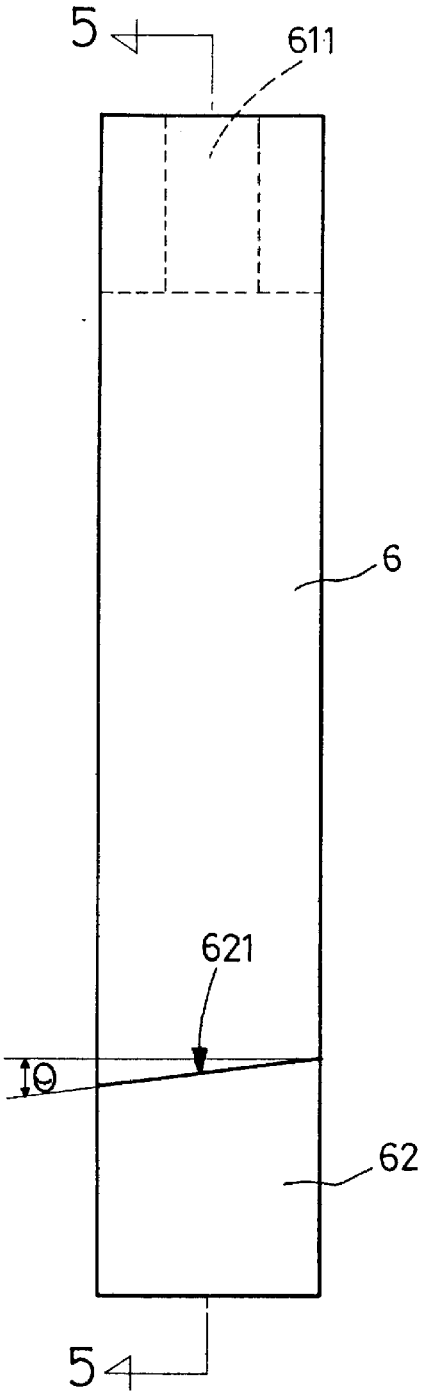
FIG. 4 is a front view of the positioning device shown in FIG. 2.
Figure 5:
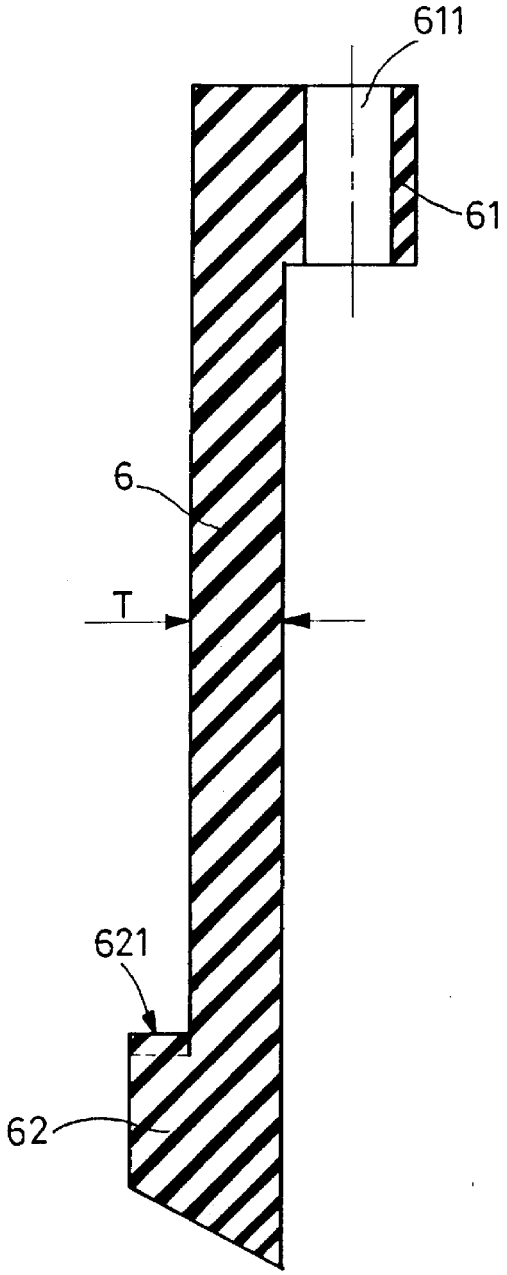
FIG. 5 is a cross sectional view of the positiollinig device taken from line 5—5 of FIG. 4.

As shown in FIGS. 2 and 3, the width (W) of the positioning device 6 is identical to the width (W) of the slot 43 and the thickness (T) will be thicker then the thickness (t) of the slot 43 about forty (40) to sixty (60) lines. By this arrangement, the concave 5 is completely and substantially connected to the top cell 4 while not to the positioning device 6.

It is preferable that the adjusting bolt 7 has a square head 71.

In assembling, each of the positioning devices 6 is firstly disposed into the slot 42 and the groove 43 of the top cell 4. Then the adjusting bolt 7 is inserted from the through hole 421 and is locked into the threaded opening 611 of the positioning device 6. The projected tab 61 of the positioning device 6 is firstly disposed at the bottom of the slot 42 before the concave 5 is not moved into the top cell 4 from the bottom of the top cell 4. By this arrangement, the largest portion of the concave 6 can pass over the extension 62. Afterward, as clearly shown in FIG. 6, after the concave 5 is rested onto the inclined inner wall 41 of the top cell 4, the adjusting bolt 7 can be adjusted such that the positioning device 6 is lifted upward along the slot 42 and the groove 43. As a result, the tapped surface 621 of the extension 62 will be pressed against to the rib 54 disposed at the bottom peripheral 53 of the concave 5 and finally is completely meshed with the rib 54 disposed on the bottom peripheral 53 of the concave 5. Since a plurality of positioning devices 6 are provided and applied, the concave 5 can be fixedly supported by the extensions 62 of the positioning device 6.

Figure 6:
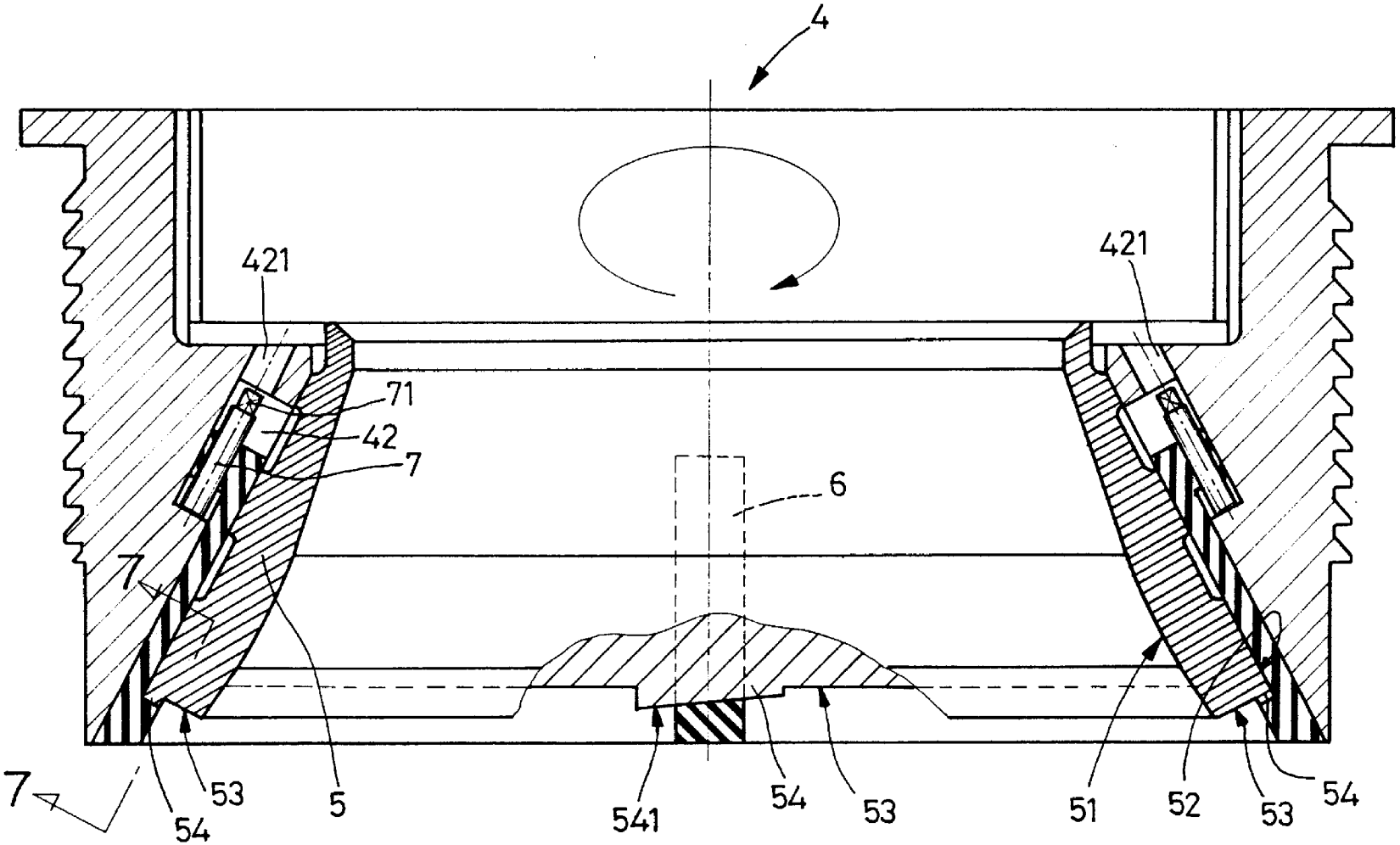
FIG. 6 is a cross sectional view of the concave of the cone crusher.
Figure 7:
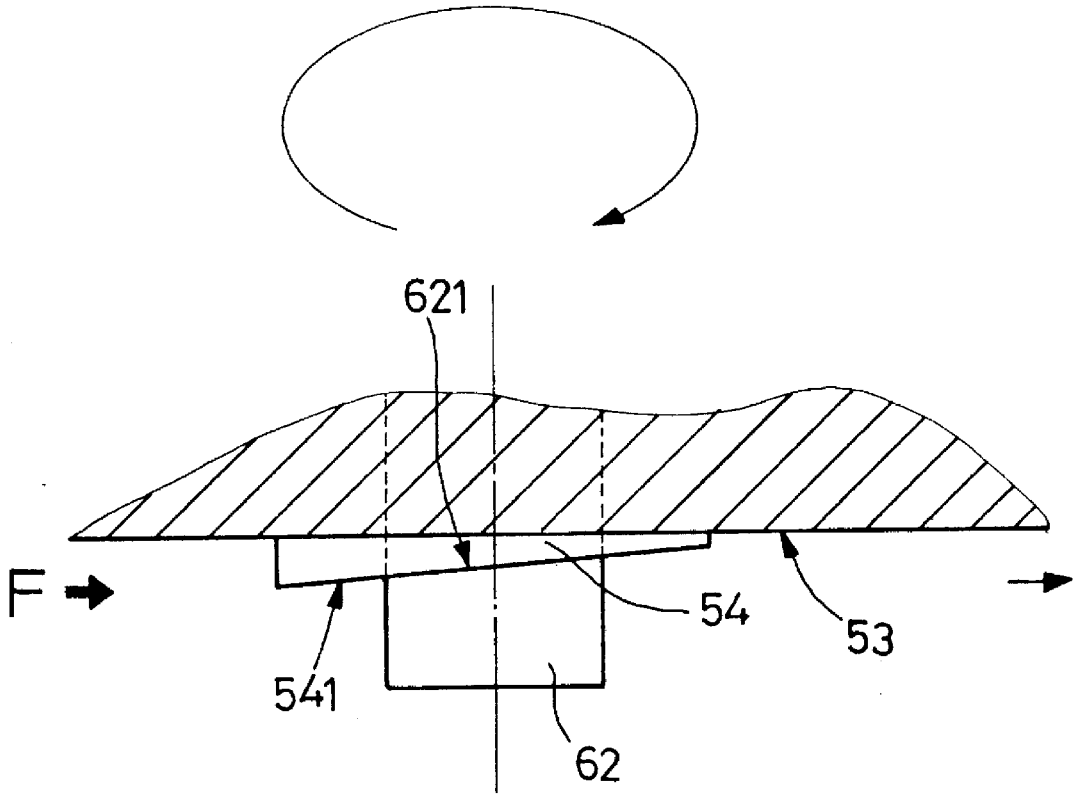
FIG. 7 is a partial and schematic illustration showing the engagement between the concave and the positioning device.

Referring to FIGS. 6 and 7, the inclined angle of the inclined bottom surface 541 of the rib 54 of the concave 5 is identical to the tapped surface 621 of the extension 62 of the positioning device 6. On the other hand, the force (F) applied thereof can be readily used to enhance the engagement therebetween. When the mantle (not shown) is rotated clockwise to crush the rocks against the concave 5, the concave 5 is also exerted by a force (F) directed clockwise. In light of this, the stronger the crushing force transferred to the concave 5, the stronger the engagement between the concave 5 and the positioning device 4 as resulted from the inclined engagement therebetween. By this arrangement, the concave 5 will not experience a play or side movement during the working process and the concave 5 will not be removed during the crushing process.

When the concave 5 needs to be removed for replacement, the adjusting bolt 7 can be rotated in opposite position such that the positioning device 6 is slid downward to release the engagement between the extension 62 and the rib 54 of the concave 5. Finally, the concave 5 can be readily removed for installing a new one. This replacement or maintenance can be quickly performed.

Figure 8:
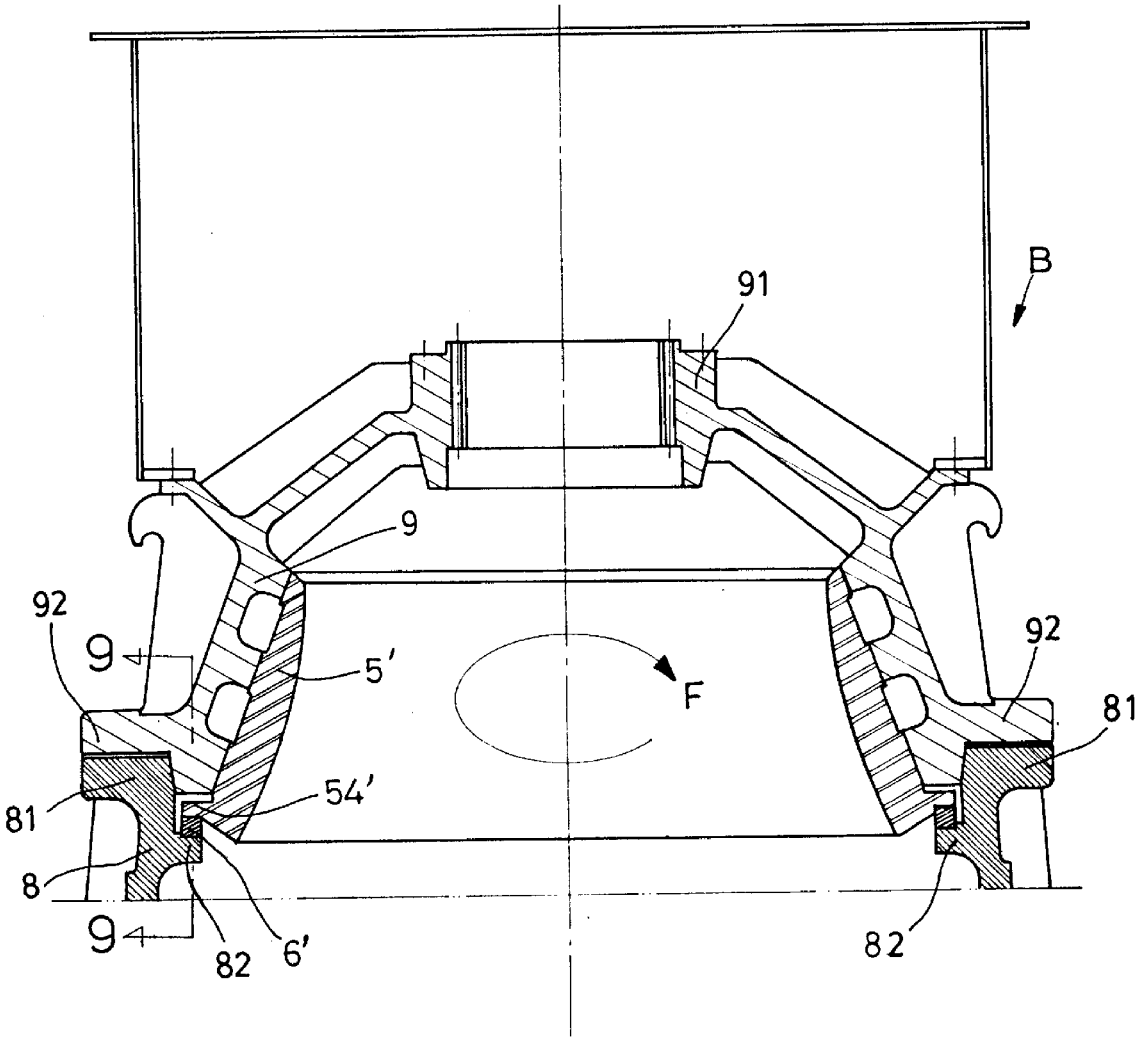
FIG. 8 is another feasible embodiment of the positioning device made according to the present invention.
Figure 9:
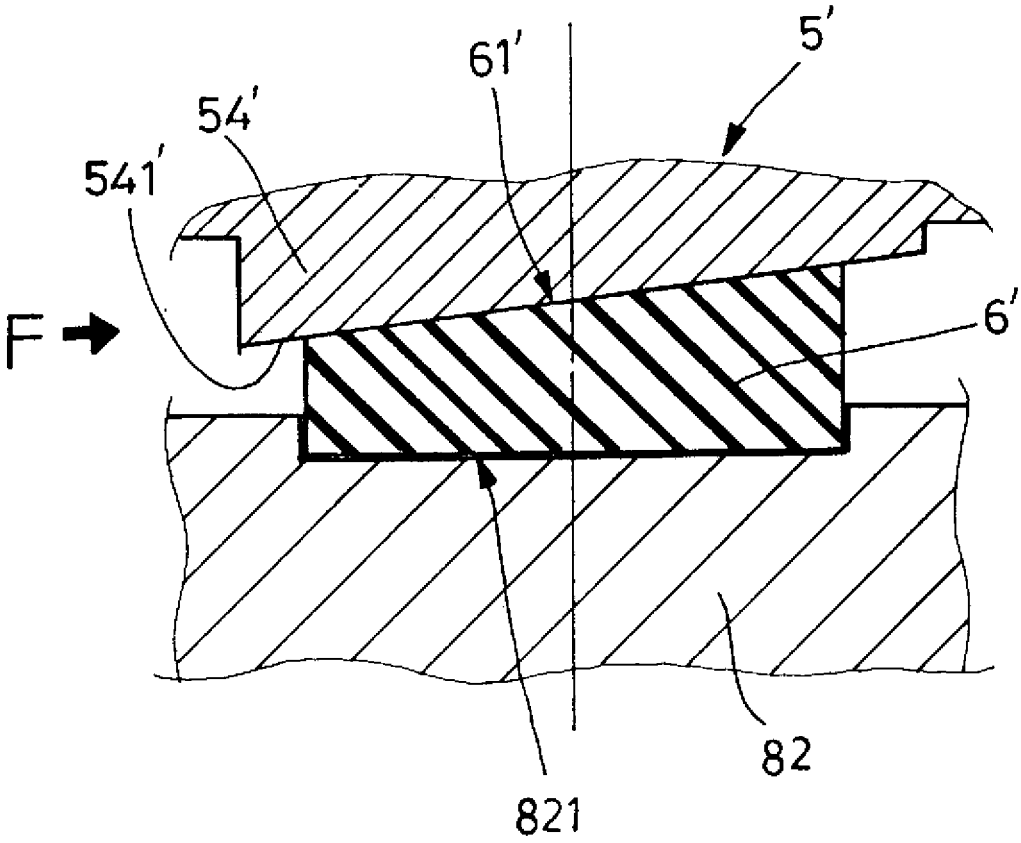
FIG. 9 is a cross sectional view taken from line 9—9 of FIG. 8.

Now referring to FIGS. 8 and 9, a second feasible embodiment for the positioning device is shown. The positioning device can be applied onto a cone crusher driven by hydraulic power. In this embodiment, the concave 5' is fixedly attached to the bottom cell 8 which it is not hanged on the top cell of the crusher A. The general configuration of this hydraulic cone crusher B includes the following components.

A bottom cell 8 is formed with a connecting flange 81 at the top peripheral and an annular flange 82 in the inner wall.

The concave 5' has a cylindrical bell configuration having a small top portion and a wider bottom portion. The concave 5' is fixed to the bottom cell 8. The concave 5' defines a crushing surface in the inner wall.

And a top cell 9 is enclosed on the upper portion of the concave 5'. The top cell 9 is provided with a shaft mounting 91 in the central portion for rotationally mounting a main shalt (not shown) thereof. The bottom of the top cell 9 is also provided with a mounting flange 92 corresponding to the connecting flange 81 of the bottom cell 8.

Characterized in that the annular flange 82 of the bottom cell 8 is provided with a plurality of slots 821 Which are symmetrically disposed with each other. Each of the slots 821 is disposed and retained with a positioning device 6' having its upper surface projected over the top surface of the slot 821 and an inclined tapped surface 61' is formed thereof.

The concave 5' is provided with a plurality of tabs 54' at the lower peripheral. Each of the tabs 54' is designed to have an inclined surface 541 which is complimentary to the inclined tapped surface 61'.

By this arrangement, when the concave 5' is disposed above the bottom cell 8, the tabs 54 can be substantially engaged with the positioning device 6'. Consequently, the concave 5' is firmly and fixedly supported by those positioning devices 6'. By this arrangement, the adjusting bolts can be conveniently eliminated. As a result, the assembling hours can be reduced and the engagement between the concave 5' and the positioning device 6' is firmly for life long operation.

The working principle and actual application between the positioning device 6' and the concave 5' are identical to the positioning device 6 and the concave 5 disclosed in the first embodiment. When the mantle 94 is rotated clockwise to crush the rocks charged between the mantle 94 and the concave 5', the concave 5' is also applied with a force (F) directed in clockwise direction. In light of this, the engagement between the concave 5' and the positioning device 6' will become tightly and tightly as long as the crushing process is proceeded. This life long engagement is benefited from the inclined tapped surfaces.

In dismounting the concave 5' when it is worn or needs to be maintained, the top cell 9 can be released from the bottom cell 8 and lifted. Then the concave 5' can be readily lifted. In light of this, the engagement between the positioning device 6' and the concave 5' can be readily released without unlocking the adjusting bolts firstly which is required in the first embodiment. The concave 5' can be readily assembled as well as dismounted with lifting equipment. In light of this, this engagement really provides an improvement and utility in assembling and dismounting the positioning device 6' and the concave 5'.

FIGS. 9 to 16 disclose another feasible and third embodiment which can be readily applied to the cone crusher driven by hydraulic power. In the third embodiment, it inherits the benefits and advantages of the third embodiment. The cone crusher generally comprises the following components.

A bottom cell 8 is formed with a connecting flange 81 at the top peripheral and an annular flange 82 in the inner wall.

The concave 5' has a cylindrical bell configuration having a small top portion and a wider bottom portion. The concave 5' is fixed to the bottom cell 8. The concave 5' defines a crushing surface in the inner wall.

And a top cell 9 is enclosed on the upper portion of the concave 5'. The top cell 9 is provided with a shaft mounting 91 in the central portion for rotationally mounting a main shaft 93 (not shown) together with a mantle 94 thereof. The bottom of the top cell 9 is also provided with a mounting flange 92 corresponding to the connecting flange 81 of the bottom cell 8.

A locking bolt 95 is provided to connect the top cell 9 and the bottom cell 8.

And a flange 10 is disposed between the bottom cell 8 and the concave 5'.

Characterized in that, as referring to FIGS. 13 to 16, the annular flange 82 of the bottom cell 8 is provided with a plurality of slots 821 which are symmetrically disposed with each other. Each of the slot 821 is disposed with a mounting bolt 100 which is flushed to the bottom of the slot to mount a lower positioning device 83 having its upper surface projected over the top surface of the slot 821 and an inclined tapped surface 831 is formed thereof.

The concave 5' is provided with a plurality of tabs 51' at the outer peripheral.

The flange 10 is disposed between the bottom cell 8 and the concave 5'. The contacting surface 101 of the flange 10 which faces the tabs 51 of the concave 5' is provided with a plurality of key slots 102 corresponding to each of the tabs 51' of the concave 5'. Each of the key slots 102 provides a receiving space for mounting a stopper 103 by means of a mounting bolt 100. When the stopper 103 is installed, the stopper 103 projected over a certain height and it serves a mounting for the tabs 51 of the concave 5' which may exert a side force to the stopper 103. The contacting surface 101 of the flange 10 further includes a plurality of through holes 104 corresponding to each of the lower positioning devices 83. As a result, the upper positioning device 105 can be disposed within the slot 106 of the flange 10 by means of the mounting bolt 105. The upper positioning device 105 is provided with a complimentary inclined tapped surface 1051 corresponding to the lower positioning device 83.

By this arrangement, when the concave 5' is disposed above the bottom cell 8 by means of the flange 10. the upper positioning device 105 of the flange 10 will be smoothly engaged with the lower positioning device 83 of the bottom cell 8. As a result, the flange 10 and the concave 5' supported thereon can be fixedly and firmly supported by the lower positioning device 83. By this arrangement, the adjusting bolts can be conveniently, eliminated. As a result, the assembling hours can be reduced and the engagement between the concave and the positioning device is firmly for life long operation.

Figure 16:
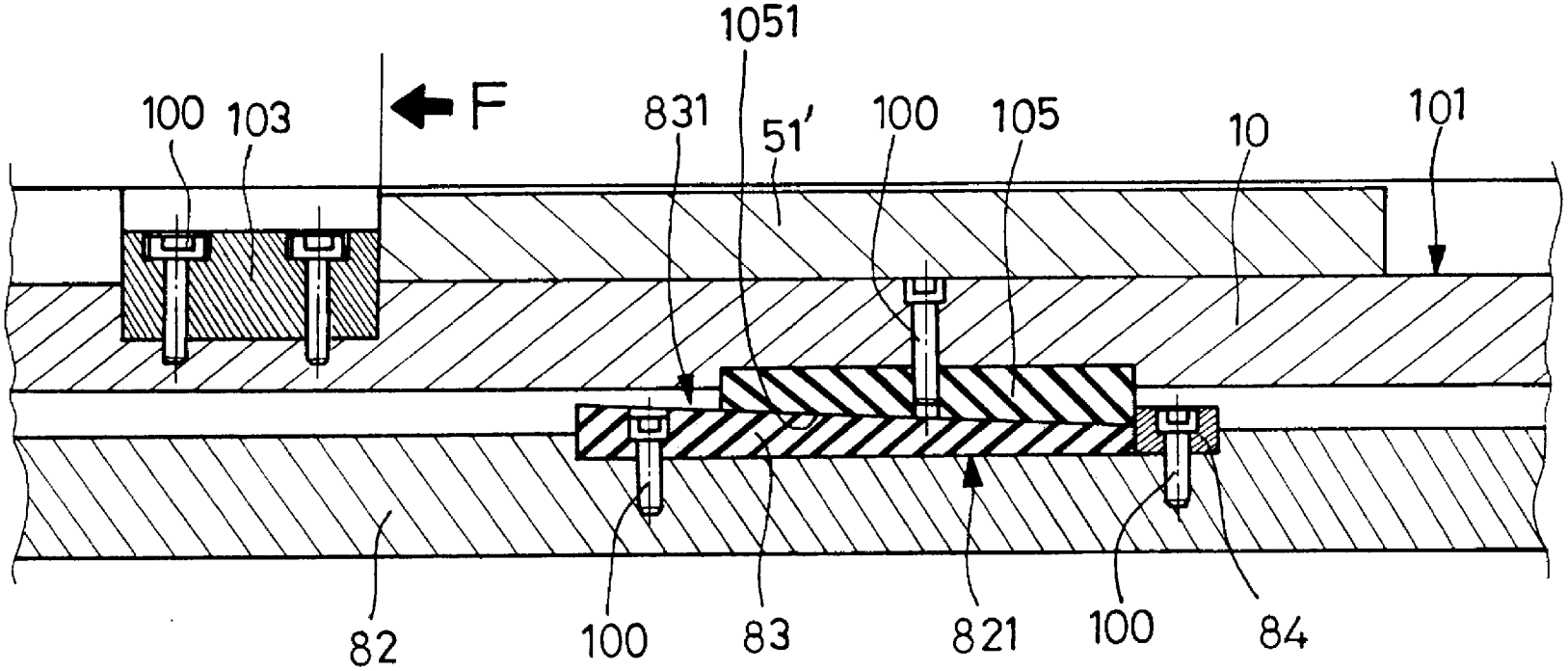
FIG. 16 is a cross sectional view taken from line 16—16 of FIG. 15

As shown in FIG. 16, one of the slot 821 of the bottom cell 8 is additionally disposed with a referring block 84 which is mounted thereof by means of the mounting bolt 100. The referring block 84 is located adjacent to the narrow end of the lower positioning device 83. The height of the referring block 84 is higher than the narrow end and it serves as the basic reference line for the upper positioning device 105 and the lower positioning device 83 when those two are contacted with each other.

Figure 14:
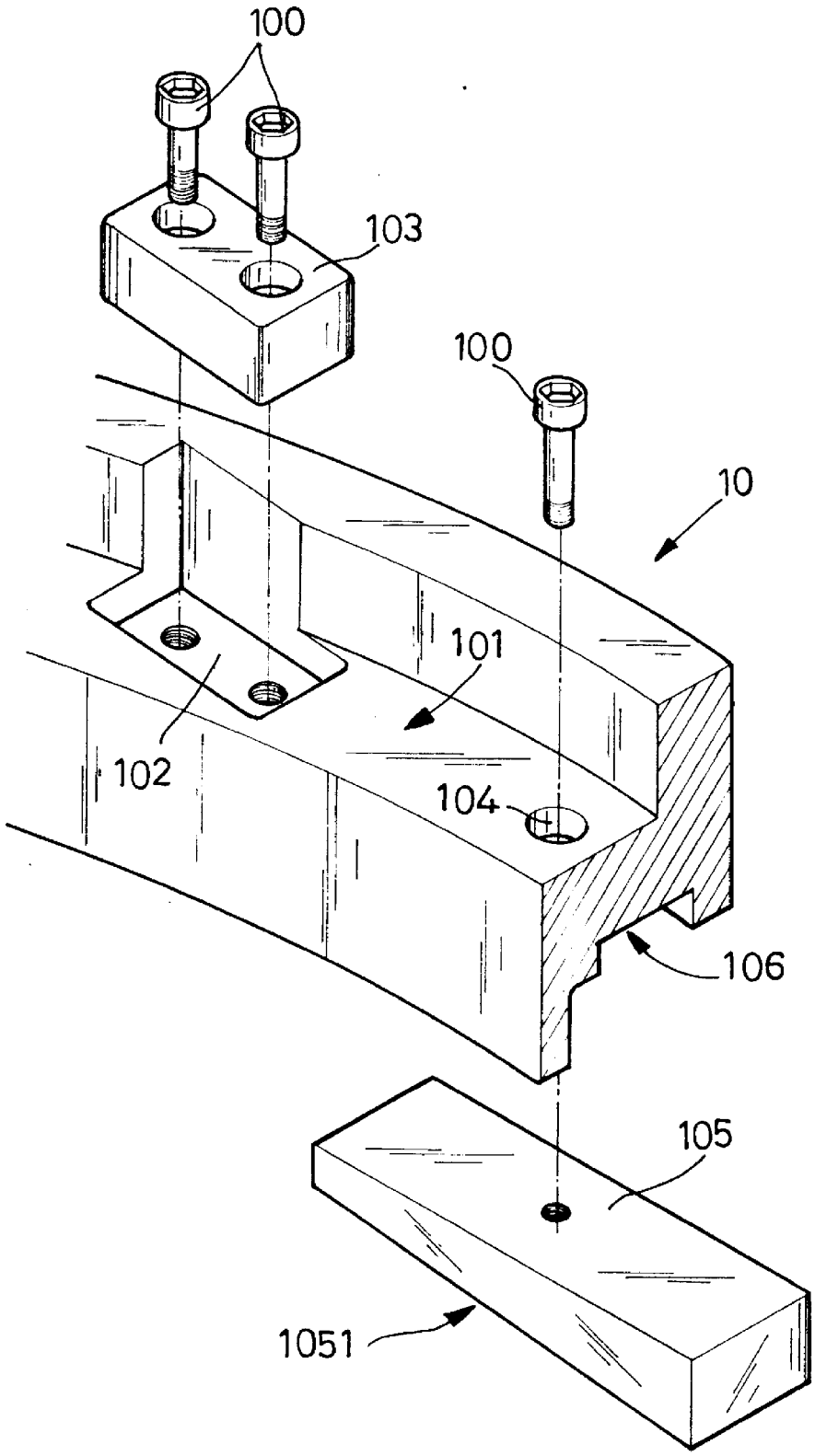
FIG. 14 is an exploded and schematic illustration of the flange mechanism shown in FIG. 13.

The assembling for the third embodiment is preferably shown in FIG. 14. The stopper 103 and the upper positioning device 105 are firstly mounted onto the flange 10 by means of the mounting bolts 100. This semi-assembled flange 10 can be clearly shown in FIG. 12, a top plan view. Afterward, the concave 5' can be firmly disposed onto the flange 10, as clearly shown in FIG. 13.

Figure 10:
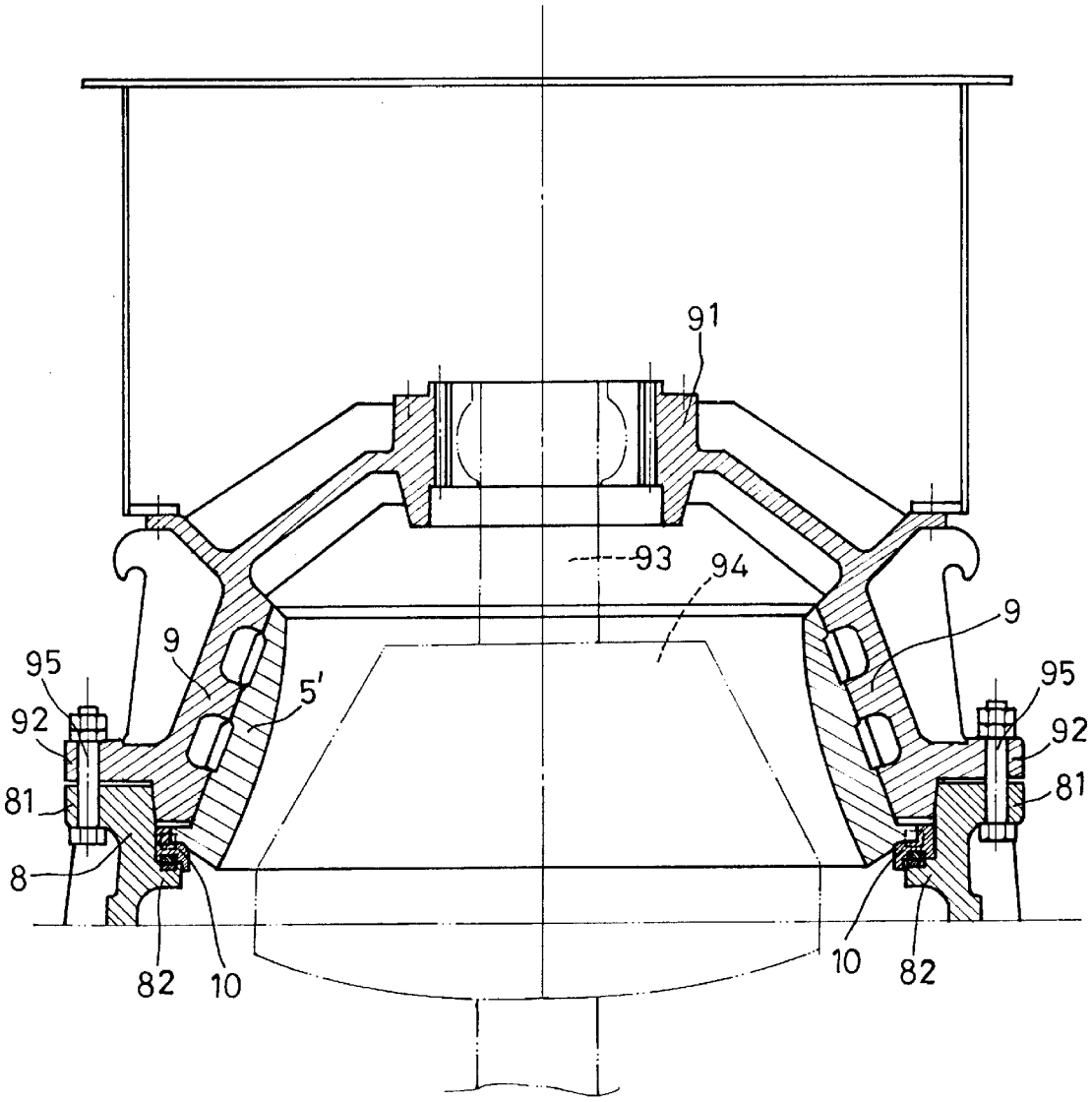
FIG. 10 is another feasible embodiment of the positioning device made according to the present invention.
Figure 11:
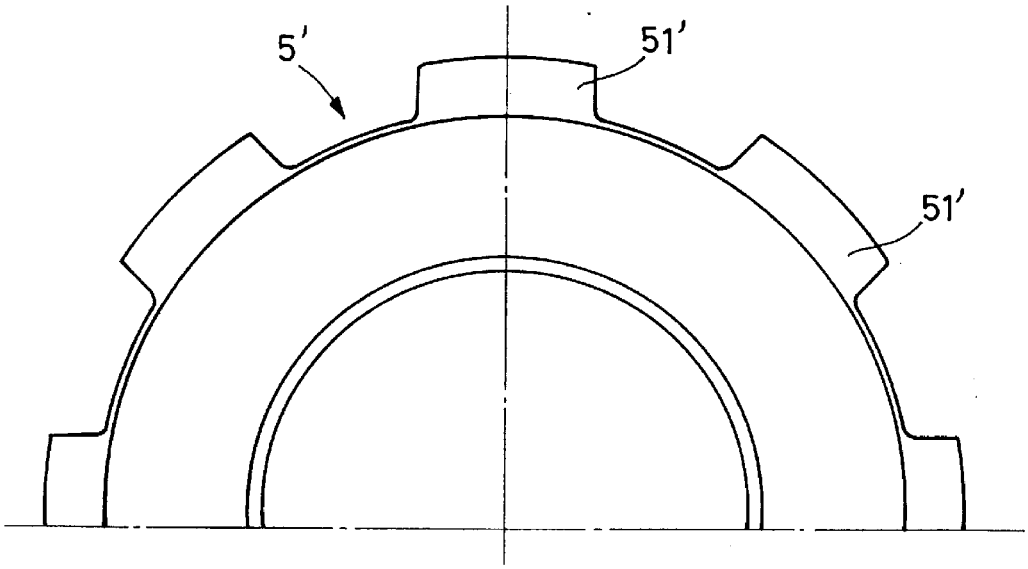
FIG. 11 is a top plan view of the positioning device shown in FIG. 10.
Figure 12:
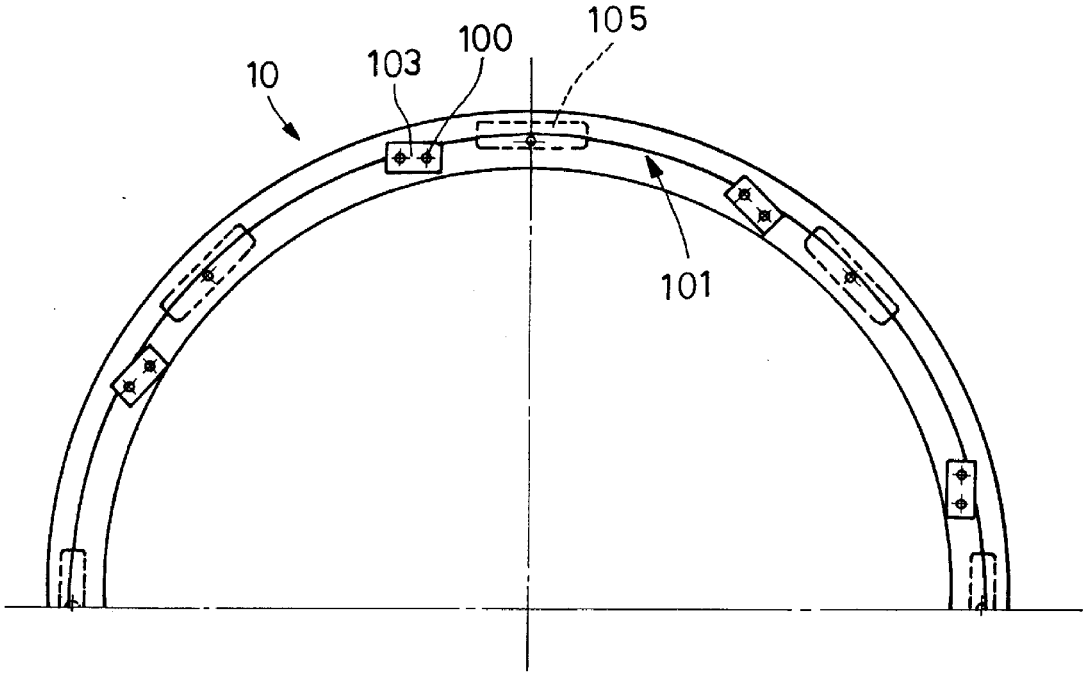
FIG. 12 is a top plan view of the positioning device wherein only half is shown.
Figure 13:
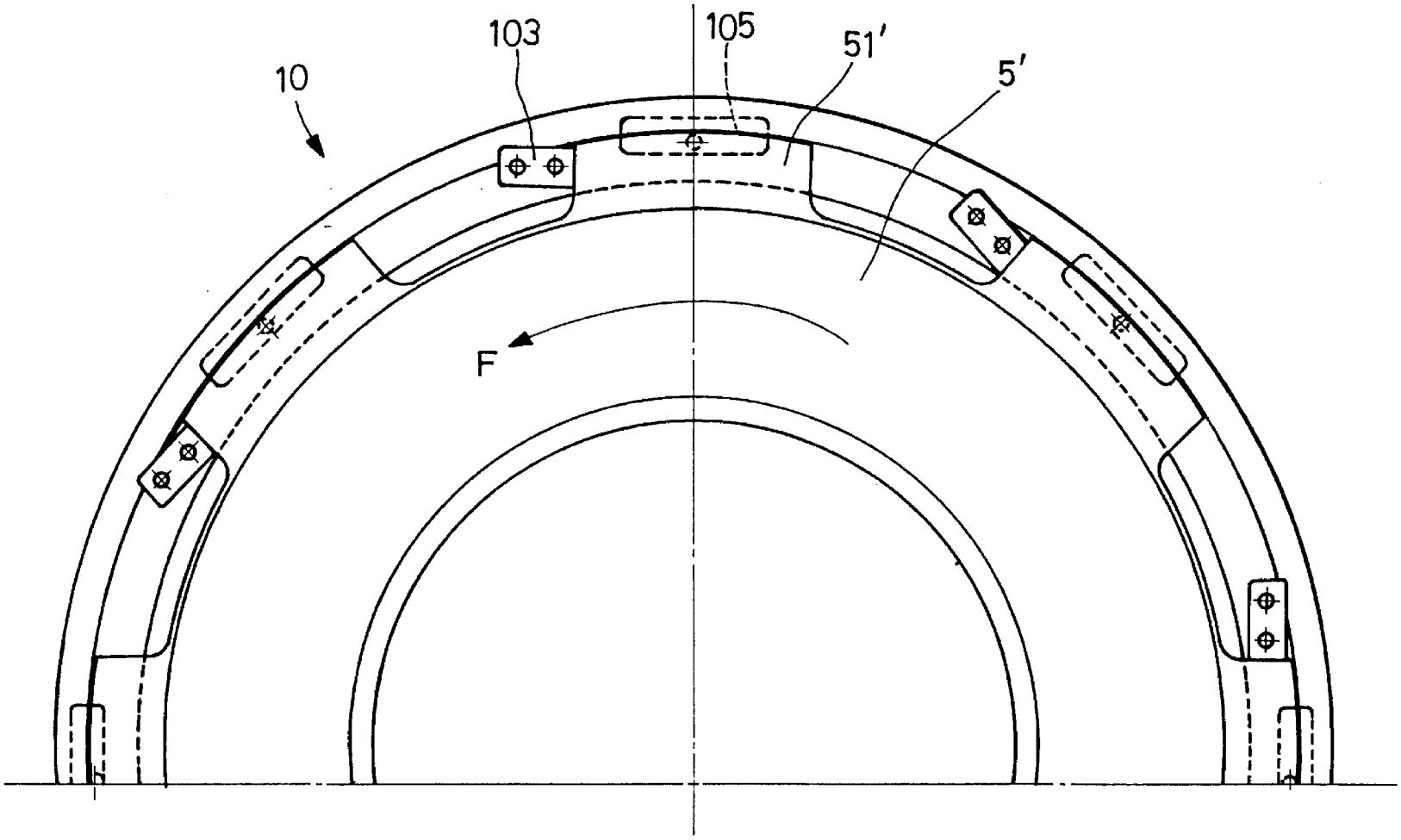
FIG. 13 is a top plan view showing the engagement between the concave and the flange.
Figure 15:
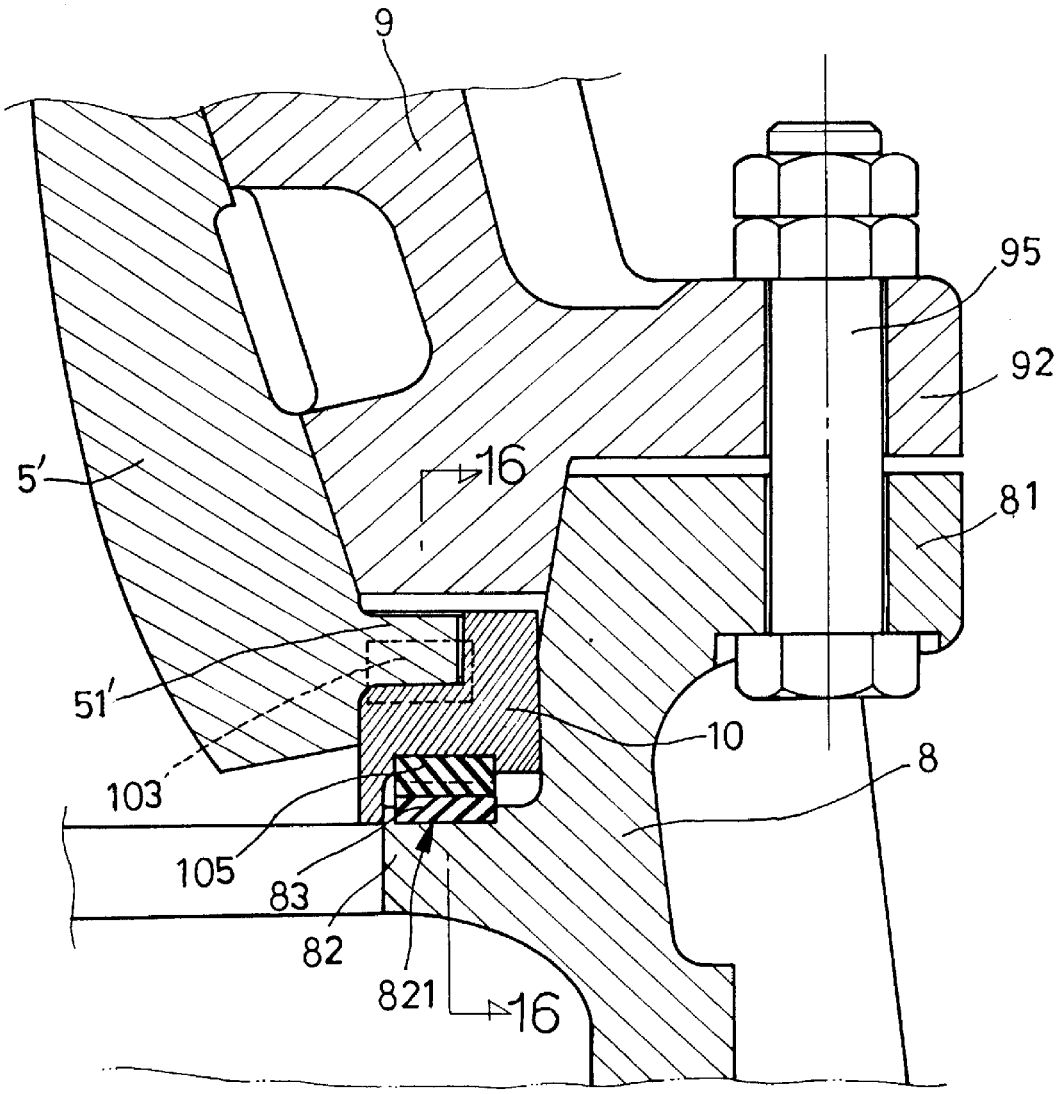
FIG. 15 cross sectional view showing the positioning device shown in FIG. 14.

Referring to FIGS. 1, 15 and 16, the lower positioning device 83 and the referring block 84 are mounted to the slot 821 of the flange 82 of the bottom cell 8 by means of the mounting bolts 100. Then the flange 10 is disposed above the bottom cell 8. The referring block 84 is served as a reference point and let one of the upper positioning device 105 engages with the referring block 84. Then the concave 5' can be disposed above the flange 10 and then applying the locking bolt 95 to lock the top cell 9 and the bottom cell 8. FIG. 10 shows a cross sectional view after the top and bottom cells 9 and 8 are assembled.

When the mantle 94 is rotated to crush the rocks against to the concave 5', a force (F) directed counterclocklvise is exerted to the concave 5' to bias the stopper 103. The applied force is further transferred to the upper positioning device 105 via the flange 10 from the stopper 103. By this arrangement, as long as the concave 5' is in service, the concave 5' is fixedly attached thereof resulted from the complimentary engagement between the inclined tapped surfaces between the upper positioning device 105 of the flange 10 and the lower positioning device 83 as the tabs 51 and the stoppers 103 of the flange 10 are pressed against with each other. By the complimentary engagement between the inclined tapped surfaces 1051 and 831, the concave 5' is firmly biased upward. As a result, the engagement between the concave 5' and the top cell 9 is tighter and tighter.

I claim:

1. An improved positioning device for concave of cone crusher, comprising:

a top cell having a cylindrical bell shape which has a larger top portion and a small lower portion and an inclined inner wall being defined between the top portion and the lower portion;

a concave having a cylindrical bell shape which has a larger top portion and a small lower portion, the inner wall of said concave being a working surface for crushing the rocks and the outer wall being shaped to meet complimentary to said inclined surface of said top cell; and a positioning device which is used to attach fixedly said concave to said inclined inner wall of said top cell;

characterized in that said inclined inner wall of said top cell is provided with a plurality of slots which are symmetrically to each other, a shallow groove being formed below said slot and a through hole which passes through said top cell being disposed above said slot;

said concave being provided with an inclined rib which is corresponding to said slot of said top cell at the lower peripheral, the inclined angle of said bottom inclining surface of the rib being identical to each other;

said positioning device being formed with a projected tab which faces to said slot of said top cell, said tab being provided with a threaded opening in which a locking bolt can be locked thereof through said through hole, the bottom surface of said positioning device which faces said inner surface of said concave being formed with an extension which has a tapped surface corresponding to the bottom inclining surface of said rib;

wherein when said positioning, device is readily inserted into said slot and said groove, it can be adjusted by a locking bolt for adjusting the height of said positioning device such that said tapped surface of said extension provides a substantial support to said rib of said concave.

2. An improved positioning device for concave of cone crusher, comprising:

a bottom cell which is formed with a connecting flange at the top peripheral and an annular flange in the inner wall;

a concave which has a cylindrical bell configuration and having a small top portion and a wider bottom portion, said concave being fixed to said bottom cell, said concave defining a crushing surface in the inner wall; and a top cell which is enclosed on the upper portion of said concave, said top cell being provided with a shaft mounting, in the central portion for rotationally mounting a main shaft thereof, the bottom of said top cell being provided with a mounting flange corresponding to said connecting flange of said bottom cell;

characterized in that said annular flange of said bottom cell is provided with a plurality of slots which are symmetrically disposed with each other, each of the slots being disposed and retained with a positioning device which has its upper surface projected over the top surface of said slot and an inclined tapped surface being formed thereof, said concave being provided with a plurality of tabs at the lower peripheral, each of said tabs being designed to have an inclined surface which is complimentary to said inclined tapped surface;

wherein when said concave is disposed above said bottom cell, said tabs can be substantially engaged with said positioning device such that the concave is firmly and fixedly supported by those positioning devices without the utilization of the adjusting bolts.

3. An improved positioning device for concave of cone crusher, comprising:

a bottom cell which is formed with a connecting flange at the top peripheral and an annular flange in the inner wall;

a concave which has a cylindrical bell configuration having a small top portion and a wider bottom portion, said concave being fixed to said bottom cell, said concave defining a crushing surface in the inner wall;

a top cell which is enclosed on the upper portion of said concave, said top cell being provided with a shaft mounting in the central portion for rotationally mounting a main shaft together with a mantle thereof, the bottom of said top cell being provided with a mounting flange corresponding to said connecting flange of said bottom cell;

a locking bolt which is provided to connect said top cell and said bottom cell; and a flange which is disposed between said bottom cell and said concave;

characterized in that said annular flange of said bottom cell is provided with a plurality of slots which are symmetrically disposed with each other, each of said slot being disposed with a lower positioning device having its upper surface projected over the top surface of said slot by means of a mounting bolt and an inclined tapped surface being formed thereof, said concave being provided with a plurality of tabs at the outer peripheral said flange being disposed between said bottom cell and said concave, the contacting surface of said flange which faces said tabs of said concave being provided with a plurality of key slots corresponding to each of said tabs of said concave, each of said key slots being provides a receiving space for mounting a stopper by means of a mounting bolt and which is projected over a certain height and serving as a mounting for said tabs of said concave which in turn exerts a side force to said stopper, said contacting surface of said flange including a plurality of through holes corresponding to each of said lower positioning devices, wherein said upper positioning device can be disposed within said slot of said flange by means of said mounting bolt, said upper positioning device being provided with a complimentary inclined tapped surface corresponding to said lower positioning device;

wherein when said concave is disposed above said bottom cell by means of said flange, said upper positioning device of said flange will be smoothly engaged with said lower positioning device of said bottom cell, said flange and the concave supported thereon being fixedly and firmly supported by said lower positioning device.

4. An improved positioning device for the concave of cone crusher as recited in claim 3, wherein one of said slot of said bottom cell is additionally disposed with a referring block which is mounted thereof by means of a mounting bolt, said referring block being located adjacent to the narrow end of said lower positioning device, the height of said referring block being higher than the narrow end and it serves as the basic reference line for said upper positioning device and said lower positioning device when those two are contacted with each other.

* * * * *